US006921005B2

(12) United States Patent
Mizukawa et al.

(10) Patent No.: US 6,921,005 B2
(45) Date of Patent: Jul. 26, 2005

(54) DISPENSING APPARATUS WITH MEASURED CHAMBER AND AEROSOL TYPE DISPENSER THEREWITH

(75) Inventors: Masumi Mizukawa, Tokyo (JP); Yasuo Ohshima, Tokyo (JP); Kiyomitsu Kanai, Tokyo (JP)

(73) Assignee: Matani Valve Co. (JP)

( * ) Notice: Subject to any disclaimer, the term of this patent is extended or adjusted under 35 U.S.C. 154(b) by 41 days.

(21) Appl. No.: 10/445,767

(22) Filed: May 27, 2003

(65) Prior Publication Data

US 2003/0230601 A1 Dec. 18, 2003

(30) Foreign Application Priority Data

May 28, 2002 (JP) ..... 2002-154784

(51) Int. Cl.[7] ..... B65D 83/00
(52) U.S. Cl. ..... 222/402.1
(58) Field of Search ..... 222/402.1, 321.1, 222/321.2

(56) References Cited

U.S. PATENT DOCUMENTS 4,025,046 A * 5/1977 Boris ..... 222/321.2
4,964,547 A * 10/1990 Lina ..... 222/402.1
2004/0074926 A1 * 4/2004 Petit ..... 222/402.1

* cited by examiner

*Primary Examiner*—Philippe Derakshani
(74) *Attorney, Agent, or Firm*—Muserlian, Lucas and Mercanti

(57) ABSTRACT

A dispensing apparatus and an aerosol type dispenser therewith for discharging contents stored in a measured chamber effectively. The dispensing apparatus is comprised of a cylindrical portion for providing a circular recess portion which keeps a part of the contents in the measured chamber and a cylindrical skirt for providing a detour in the circular recess portion. The cylindrical portion and/or the cylindrical skirt form grooves so as to make a sectional area for flowing contents smaller. In mode in use, the upstream contents positioned inside space of the cylindrical skirt take a long way around the circular recess portion at high speed and high pressure, therewith contents settled in the circular recess portion are forced to sent to the passage of the valve stem certainly.

9 Claims, 7 Drawing Sheets

(a) Mode in nonuse (b) Mode in use (a) Mode in nonuse (b) Mode in use (a) Mode in nonuse (b) Mode in use (a) Mode in nonuse (b) Mode in use

DISPENSING APPARATUS WITH MEASURED CHAMBER AND AEROSOL TYPE DISPENSER THEREWITH

BACKGROUND OF THE INVENTION

1. Field of the Invention

The present invention relates to a dispensing apparatus with a measured chamber and an aerosol type dispenser therewith, more particularly, relates to the dispensing apparatus for discharging the contents stored in the measured chamber which is provided when a valve stem moves to a housing in a sealing manner.

According to the present invention, various kinds of material for example, powder, gel, foaming agents, low viscosity liquid etc. can be used as the contents.

Now, "contents" sometimes mean both discharging gas (liquid gas, compressed gas) and the above-mentioned substantial material in this specification.

In the dispensing apparatus with measured chamber (contents keeping space), the above-mentioned materials are apt to settle in the measured chamber. The present invention relates to the dispensing apparatus for discharging the settled material, effectively.

2. Description of the Related Art

The conventional dispensing apparatus with a measured chamber forms a cylindrical standing portion in a housing for providing a lower space which keeps a part of the contents in the measured chamber. The lower space is surrounded by the outer surface of the cylindrical standing portion, the bottom and the inner surface of the housing. A valve stem moves to contact the cylindrical standing portion in order to form the measured chamber. The measured chamber is also comprised of an upper space between the lower space and a discharging aperture of the valve stem.

In the mode in nonuse, since the valve stem does not contact the cylindrical standing portion, the contents flow from a container beyond the cylindrical standing portion and are stored in the measured chamber.

Since the lower space is recess portion in the measured chamber, in the mode in nonuse the contents are apt to settle in this area.

In the mode in use, when the measured chamber communicates to the outside through the aperture, the contents (and discharging gas) in the upper space of the measured chamber are apt to move toward the aperture straight.

Namely, the contents in the upper space of the measured chamber don't move toward the lower space before going to discharging aperture. Therefore, the contents in the lower space are discharged only by their own gas pressure.

Therewith, in the mode in use, most contents in the lower space of the measured chamber are hard to be discharged outside through the aperture (of the valve stem).

An object of the present invention is to discharge contents in the lower space of a measured chamber, effectively.

SUMMARY OF THE INVENTION

A dispensing apparatus with a measured chamber and an aerosol type dispenser therewith in order to discharge contents in the lower space of a measured chamber effectively have now been discovered.

The present invention is comprised of a first cylindrical portion for providing a lower space and a second cylindrical portion for providing a detour in the lower space. By virtue of the features, the lower space is formed in the measured chamber and a detour is formed in the lower space. In mode in use, the contents in the upper space of the measured chamber go around the lower space before going to an aperture of the valve stem. According to this action, the settled contents in the lower space are forced to move toward the aperture of the valve stem so as to discharge outside, effectively.

In one preferred mode, a cylindrical attachment is employed as the first cylindrical portion, so that the conventional housing can be used.

In one preferred mode, the second cylindrical portion is a member of the valve stem.

In one preferred mode, the second cylindrical portion is an another member of the valve stem, so that the conventional valve stem can be used.

In one preferred mode, a fork-shaped flexible portion is formed In the lower end of the valve stem, so that the settled contents in the lower space are scratched in order to be discharged effectively.

In one preferred mode, a relative convex portion is formed on the outer surface of the first cylindrical portion or on the inner surface of the second cylindrical portion which comprise the downward upstream passage in the lower space.

In one preferred mode, a relative convex portion is formed on the outer surface of the second cylindrical portion or the inner surface of the housing which comprise the upward downstream passage in the lower space.

Therefore, the cross sectional area of the passage for flowing contents in the lower space is made to be small, so that the flow of the contents from the upper space are accelerated. This acceleration made the settled contents in the contents keeping space moved toward the aperture or the valve stem effectively.

The relative convex portion means not only the convex portion formed on said surface but also the other portion except a concave portion when the concave portion is formed.

In one preferred mode, the relative convex portion is formed obliquely on the outer surface of the first cylindrical portion or/and the inner surface of the second cylindrical portion, or the outer surface of the second cylindrical portion or/and the inner surface of the housing so that the flow of the contents from the upper space is made to be spiral. Therefore, the settled contents in the lower space are mixed and certainly sent to the aperture of the valve stem.

The present invention also discloses aerosol type dispenser with the dispensing apparatus having the above-identified features.

BRIEF DESCRIPTION OF THE DRAWINGS

FIG. 5(*a*) illustrates a cylindrical attachment forming spiral grooves on the outer surface. FIG. 5(*b*) illustrates a valve stem forming spiral grooves on the inner surface and corresponding the cylindrical attachment.

In FIG. 1 to FIG. 4, FIG. 6 and FIG. 7, each (*a*) shows a mode in nonuse that the measured chamber does not communicate with outside, and each (*b*) shows the mode in use that the measured chamber communicates with outside.

DETAILED DESCRIPTION OF THE INVENTION

Figure 1:
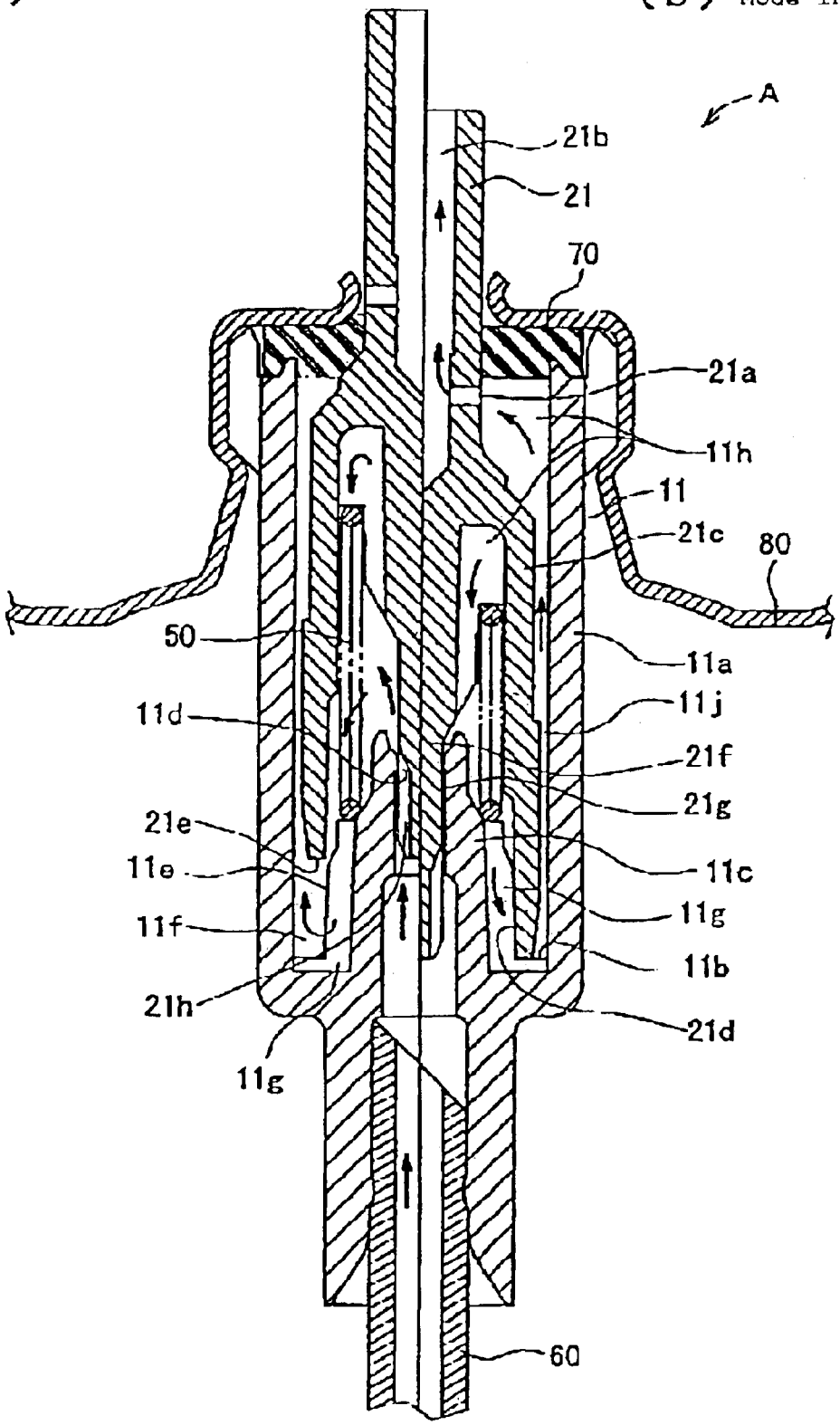
FIG. 1 illustrates a dispensing apparatus with a measured chamber (A), that the outer surface of a cylindrical standing portion which comprises a circular recess portion for keeping powder forms grooves for passing contents.

In the figures, each (A), (B), (C), (D), (E), (F) shows a dispensing apparatus with a measured chamber. 11, 12, 13, 14, 15, 16 shows a housing. 11(*a*), 12(*a*), 13(*a*), 14(*a*), 15(*a*), 16(*a*) shows an outer cylinder of the housing. 11(*b*), 12(*b*), 13(*b*), 16(*b*) shows a convex portion between grooves formed on a bottom of the housing. 11(*c*), 12(*c*), 13(*c*), 15(*c*), 16(*c*) shows a cylindrical standing portion for providing a circular recess portion for keeping powder and a measured chamber 11(*d*), 12(*d*), 16(*d*) shows an annular project portion formed on the inner surface of the cylindrical standing portion for contacting a pillar-shaped portion of a valve stem in a sealing manner. 11(*e*), 12(*e*), 13(*e*), 15(*e*), 16(*e*) shows a convex portion formed on the outer surface of the cylindrical standing portion. 11(*f*), 12(*f*), 13(*f*), 15(*f*), 16(*f*) shows a circular recess portion for keeping powder between the cylindrical standing portion and the housing. 11(*g*), 12(*g*), 13(*g*), 16(*g*) shows a groove formed on the outer surface of the cylindrical standing portion and on the bottom of the housing. 15(*g*) shows a groove formed on the outer surface of the cylindrical standing portion 15(*c*). 11(*h*), 12(*h*), 14(*h*), 16(*h*) shows a measured chamber. 11(*j*), 12(*j*), 13(*j*), 14(*j*), 15(*j*) shows a space between the outer cylinder of the housing and a cylindrical skirt of a valve stem. 12(*i*), 16(*i*) shows a groove formed on the inner surface of the outer cylinder 12(*a*), 16(*a*) so as to continue from the groove 12(*g*), 16(*g*), respectively 14(*i*) shows an annular concave portion for setting a cylindrical attachment 31. 15(*b*) shows a bottom of the circular recess portion 15(*f*). 16(*k*) shows a convex portion relatively formed between grooves 16(*i*) of the housing 16. 21, 22, 23, 24, 25, 26, 27 shows a valve stem. 21(*a*), 22(*a*), 23(*a*), 24(*a*), 25(*a*), 26(*a*), 27(*a*) shows an aperture of the valve stem. 21(*b*), 22(*b*), 24(*b*), 27(*b*) shows a passage of the valve stem. 21(*c*), 22(*c*), 23(*c*), 24(*c*), 25(*c*), 26(*c*) shows a cylindrical skirt of the valve stem. 21(*d*), 22(*d*), 24(*d*), 25(*d*) shows a lower inner surface of the cylindrical skirt. 21(*e*), 22(*e*), 23(*e*), 24(*e*), 25(*e*) shows an end of the cylindrical skirt. 21(*f*), 22(*f*), 24(*f*), 25(*f*), 27(*f*) shows a pillar-shaped portion for contacting the annular project portion 11(*d*), 12(*d*), 16(*d*), 31(*a*), 32(*a*) of the cylindrical standing portion or the cylindrical attachment in a sealing manner. 21(*g*), 22(*g*), 24(*g*), 27(*g*) shows a lower outer surface of the pillar-shaped portion. 21(*h*), 22(*h*). 23(*h*), 24(*h*), 25(*h*), 27(*h*) shows a groove formed on the pillar-shaped portion upward and downward. 22(*k*) shows a taper-shaped annular project portion formed on the lower outer surface of the cylindrical skirt 22(*e*). 23(*k*) shows an intermittent project portion formed on the lower outer surface of the cylindrical skirt 23(*c*). 23(*m*) shows a narrow space between the intermittent project portion 23(*k*). 25(*i*) shows a spiral-shaped groove formed on the inner surface of the cylindrical skirt 25(*c*) of the valve stem 25. 26(*k*) shows a flexible fork-shaped portion formed on the lower side of the cylindrical skirt 26(*c*) of the valve stem 26. 26(*m*) shows an end of the fork-shaded portion. 27(*n*) shows an annular project portion formed on the outer surface of the valve stem 27 for contacting the inner surface of a cylindrical wall part 40 in a sealing manner. 31, 32, 33 shows a cylindrical attachment for providing the measured chamber, the circular recess portion and for contacting each corresponding valve stem in a sealing manner. 31(*a*), 32(*a*), 33(*a*) shows an annular project portion for contacting the corresponding valve stem in a sealing manner. 31(*b*), 32(*b*), 33(*b*) shows a convex portion formed on the outer surface of the cylindrical attachment. 31(*c*), 32(*c*), 33(*c*) shows a brim portion. 31(*d*) shows a groove between the convex portion 31(*b*) continuously formed to the brim 31(*c*). 32(*d*) shows a spiral-shaped groove formed on the outer surface and brim 32(*c*) of the cylindrical attachment 32. 31(*e*), 32(*e*), 33(*e*) shows a leg portion. 40 shows a cylindrical wall part having same function as the cylindrical skirt 21(*c*), 22(*c*), 23(*c*), 24(*c*), 25(*c*), 26(*c*) of each valve stem 21, 22, 23, 24, 25, 26. 50 shows a spring for urging the valve stem upwardly. 60 shows a dip tube. 70 shows a gasket. 80 shows a mounting cup.

As mentioned above, the contents of the present dispensing apparatus can include various kinds of material, however, for reasons of convenience, an example that the contents include powder material is explained.

As shown in FIG. 1, the housing 11 of the dispensing apparatus(A) incorporates the cylindrical standing portion 11(*c*) with the outer cylinder 11(*a*). When the pillar-shaped portion 21(*f*) of the valve stem 21 contacts the annular project portion 11(*d*) of the cylindrical standing portion 11(*c*), the measured chamber 11(*h*) is provided. The space surrounded with the outer cylinder 11(*a*) and the cylindrical standing portion 11(*c*) is a circular recess portion 11(*f*) for keeping powder.

The plural grooves 11(*g*) are formed on the cylindrical standing portion 11(*c*) and the bottom of the housing 11. These grooves 11(*g*) are formed so that up-and-down grooves on the cylindrical standing portion 11(*c*) continue to radial grooves on the bottom of the housing.

The following are common features of the dispensing apparatus with measured chamber shown in FIG. 1, FIG. 2, FIG. 3, FIG. 4, FIG. 5, FIG. 6, FIG. 7.

(1) In mode in use, the measured chamber including the circular recess portion 11(*f*) etc. is physically partitioned into two spaces, one formed inside and the other formed outside of the valve stem by the cylindrical skirt of the valve stem or cylindrical wall part. The two spaces are communicated on the bottom side of the powder keeping space, (2) The grooves for passing the contents are formed on this communicated area and the like so as to make a sectional area for passing contents smaller.

The above-mentioned features allow following advantages.

In mode in use, the contents (powder and liquefied gas) positioned In the above-mentioned inside space of the cylindrical skirt, also in the upper side (upstream side) of the circular recess portion take a long way around the powder keeping space, therewith the contents settled in the circular recess portion are forced to sent to the passage of the valve stem.

Moreover, the above-mentioned upstream contents pass the circular recess portion at high speed and high pressure so that the settled contents in the circular recess portion are certainly discharged.

As above-mentioned, the upstream contents are discharged by the one route which is a long way around the circular recess portion, so that the contents can be discharged stable.

In the conventional dispensing apparatus with a measured chamber not employing a cylindrical skirt of a valve stem, in the mode in use the contents flow in the following 2 ways. They are, the first flow from the upper space of the measured chamber positioned above the circular recess portion to the outside (the flow doesn't take a long way around the circular recess portion), and the second flow from the circular recess portion to the outside.

A time lag between the first flow and the second flow is apt to be produced, as a result a double discharge is caused by this time lag. That is, the contents in the upper space of the measured chamber are discharged firstly, then, the contents in the circular recess portion are discharged secondly. In the case that liquefied gas is employed for the discharging gas, the contents stored in the measured chamber are discharged by evaporation of the liquefied gas. Therefore, in the case that a capacity of the measured chamber is large, when the above-mentioned double discharge is caused, the contents in the measured chamber are hard to be discharged completely because the outside is cooled by evaporation of the first discharged liquefied gas. According to the present invention, the above-mentioned unexpected double discharge is prevented.

Also, in the present invention the cylindrical standing portion or the cylindrical attachment and the cylindrical skirt or cylindrical wall part can prevent contents stored in the above-mentioned upper space of the circular recess portion or in the housing from dropping to the container when the dispensing apparatus falls down, for example in transportation.

As shown in FIG. 1(*a*) in the mode in nonuse, the valve stem 21 moves upward by urging force of the spring 50 so as to close the aperture 21(*a*), the contents are not discharged.

The annular project portion 11(*d*) of the cylindrical standing portion 11(*c*) is faced to the grooves 21(*h*) of the valve stem 21, therefore the inside space of the housing (measured chamber) communicates to the inside of a container (not shown).

After previous discharge, since the pressure in the housing 11 is lowered, powder, and liquefied gas are flown in the housing 11 through the dip tube 60 and the grooves 21(*h*).

In the case that the dispensing apparatus is left alone, the powder settles in the circular recess portion 11(*f*) because of its high specific gravity.

As shown in FIG. 1(*b*), in the mode in use, namely when the valve stem 21 is pressed against the urging force of the spring 50, the lower outer surface 21(*g*) of the pillar-shaped portion 21(*f*) of the valve stem 21 sealingly contacts the project portion 11(*d*) of the cylindrical standing portion 11(*c*) of the housing 11. So, the inside of the housing does not communicate to the inside of the container.

At this time, the lower inner surface 21(*d*) of the cylindrical skirt 21(*c*) and the end portion 21(*e*) of the cylindrical skirt 21(*c*) of the valve stem 21 contacts the convex portion 11(*e*) and 11(*b*), respectively.

Then, as the aperture 21(*a*) is released from the gasket 70, powder in the measured chamber 11(*h*) is discharged by discharging gas through the route of the grooves 11(*g*), the space 11(*j*), the aperture 21(*a*) and the passage 21(*b*).

At this time, because the contents in the upper stream of the circular recess portion 11(*f*) go around the grooves 11(*g*), the powder settled in the circular recess portion 11(*f*) are forced to be sent toward the aperture 21(*a*) effectively.

Here, the grooves 11(*g*) may be formed on the lower inner surface 21(*d*) of the cylindrical skirt 21(*c*) or the end portion 21(*c*) of the cylindrical skirt 21(*c*).

Also, in the state that the grooves are formed on the cylindrical standing portion 11(*c*) and the bottom of the housing, grooves may be formed on the lower inner surface 21(*d*) of the cylindrical skirt 21(*c*) or the end portion 21(*e*) of the cylindrical skirt 21(*c*). In this case, the grooves are formed so that they may not overlap each other.

Figure 2:
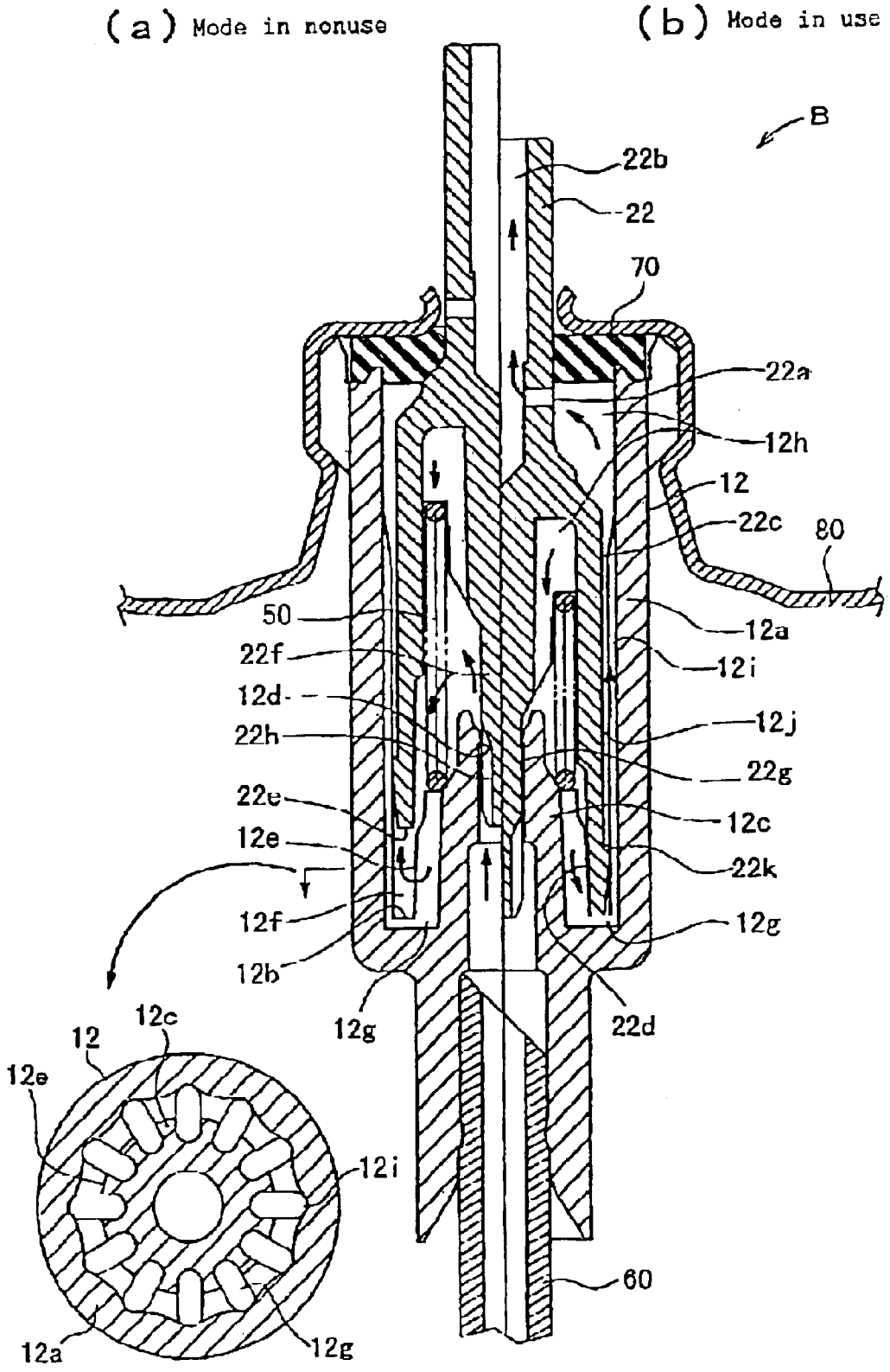
FIG. 2 illustrates a dispensing apparatus with a measured chamber (B), that the outer surface of the cylindrical standing portion and the inner surface of the housing which comprise a circular recess portion for keeping powder form grooves for passing contents.

As shown in FIG. 2, the substantial difference between the dispensing apparatus (B) and the dispensing apparatus (A) is that the grooves 12(*i*) are formed on the inner surface of the outer cylinder 12(*a*) of the housing (12) and the annular project portion 22(*k*) is formed on the lower outer surface of the cylindrical skirt 22(*c*) in the dispensing apparatus (B).

When the situation of the dispensing apparatus (B) shifts to the mode in use (shown in FIG. 2(*b*)), same as the dispensing apparatus (A) (shown in FIG. 1(*b*)), the lower outer surface 22(*g*) of the pillar portion 22(*f*) of the valve stem 22 contacts the project portion 12(*d*) of the cylindrical standing portion 12(*c*) in a sealing manner, each the lower inner surface 22(*d*) and the end 22(*e*) of the cylindrical skirt 22(*c*) contacts the convex portion 12(*e*) of the cylindrical standing portion 12(*c*) of the housing 12 and the convex portion 12(*b*), respectively, then finally the aperture 22(*a*) is opened.

The contents positioned in the upper stream of the circular recess portion 12(*f*) go around the grooves 12(*g*), 12(*i*), and then flow to the aperture 22(*a*) and passage 22(*b*).

The contents in the circular recess portion 12(*f*) are also actuated by the above-mentioned action of the upstream contents.

In the dispensing apparatus (B) the cross sectional area of the space 12(*j*) for flowing contents is smaller compared to the dispensing apparatus (A) because of the project portion relatively formed by the grooves 12(*i*).

Figure 3:
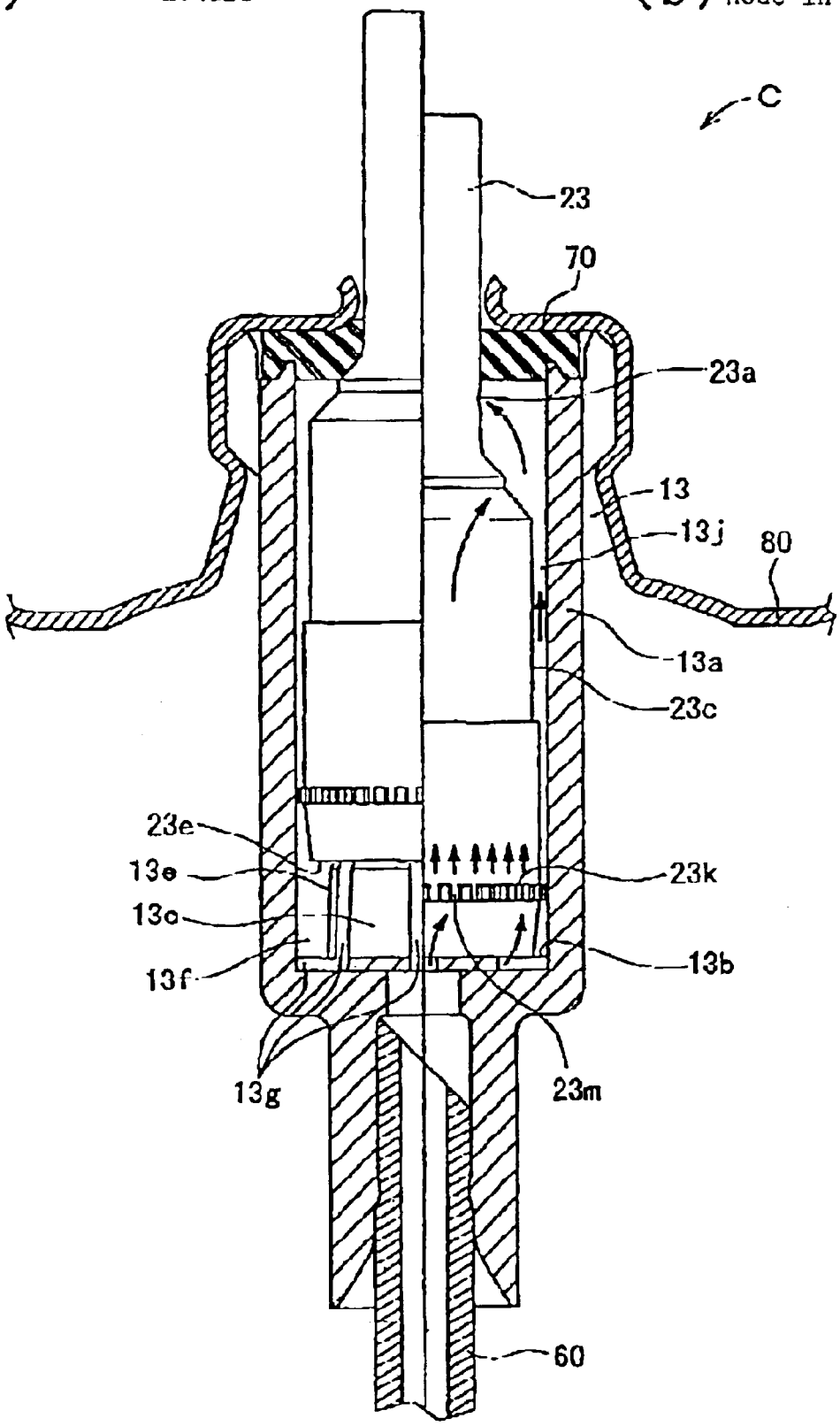
FIG. 3 illustrates a dispensing apparatus with a measured chamber (C), that the outer surface of a cylindrical standing portion which comprises a circular recess portion for keeping powder forms grooves for passing contents and the outer surface of the valve stem forms convex portions at intervals for contacting with the inner surface of the housing.

As shown in FIG. 3, the dispensing apparatus (C) employs the valve stem 23 forming the intermitted project portion 23(*k*) on the outer surface of the valve stem 21 of the dispensing apparatus (A) shown in FIG. 1.

As shown in FIG. 3(*b*), in the mode in use the contents in the circular recess portion 13(*f*) or the upper stream thereof go around the grooves 13(*g*) and the narrow space 23(*m*), then flow to the aperture 23(*a*) and the passage.

Since the cross sectional area of the groove 13(*g*) and the narrow space 23(*m*) are small, the settled contents in the circular recess portion 13(*f*) are pressurized and accelerated so that they are sent to the aperture 23(*a*) effectively.

Figure 4:
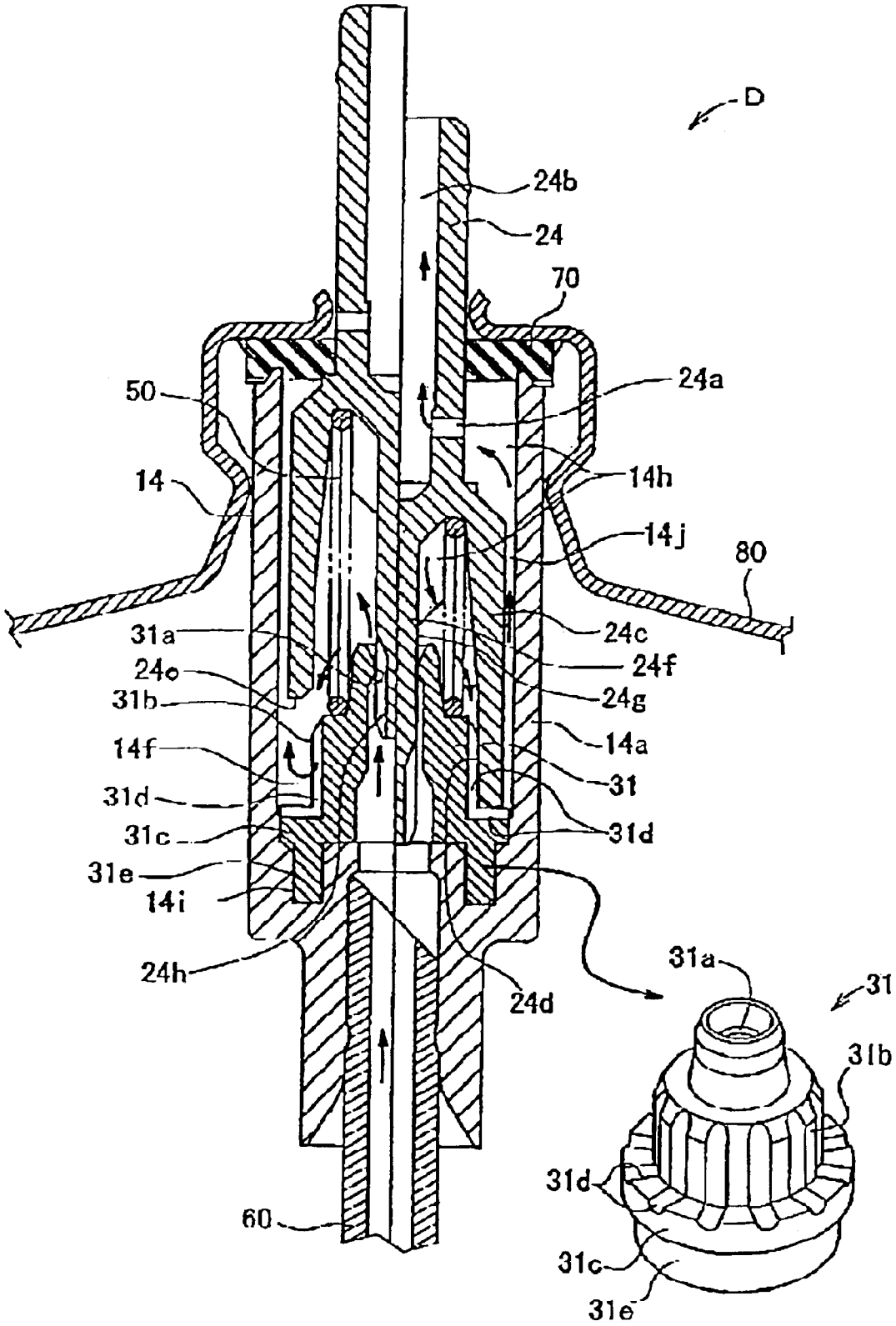
FIG. 4 illustrates a dispensing apparatus with a measured chamber (D), that a cylindrical attachment for providing a circular recess portion for keeping powder is employed instead of the cylindrical standing portion.

As shown in FIG. 4, the dispensing apparatus (D) employs the cylindrical attachment 31 instead of the cylindrical standing portion 11(*c*) of the dispensing apparatus (A).

The leg portion 31(*e*) of the cylindrical attachment 31 is snap locked in the annular concave portion 14(*i*) and the grooves 31(*d*) are formed on the outer surface and the brim portion 31(*c*).

When the situation of the dispensing apparatus shifts to the mode in use, same as the dispensing apparatus (A), the pillar-shaped portion 24(*f*) of the valve stem 24 contacts the project portion 31(*a*) of the cylindrical attachment 31 in a sealing manner. In the mode in use, the flow of the contents in the measured chamber 14(*h*) are also same as the flow in the dispensing apparatus (A).

Here, since the cylindrical attachment 31 is a separate part from the rigid housing 14, this cylindrical attachment 31 can be made of different material, for example softer material than the housing 14, seal action between the pillar-shaped portion 24(*f*) of the valve stem 24 and the project portion 31(*a*) of the cylindrical attachment 31 can be improved.

For example, valve stem 24 can be made of polyacetal (POM), on the other hand the cylindrical attachment 31 can be made of low density polyethylene (LDPE).

Figure 5:
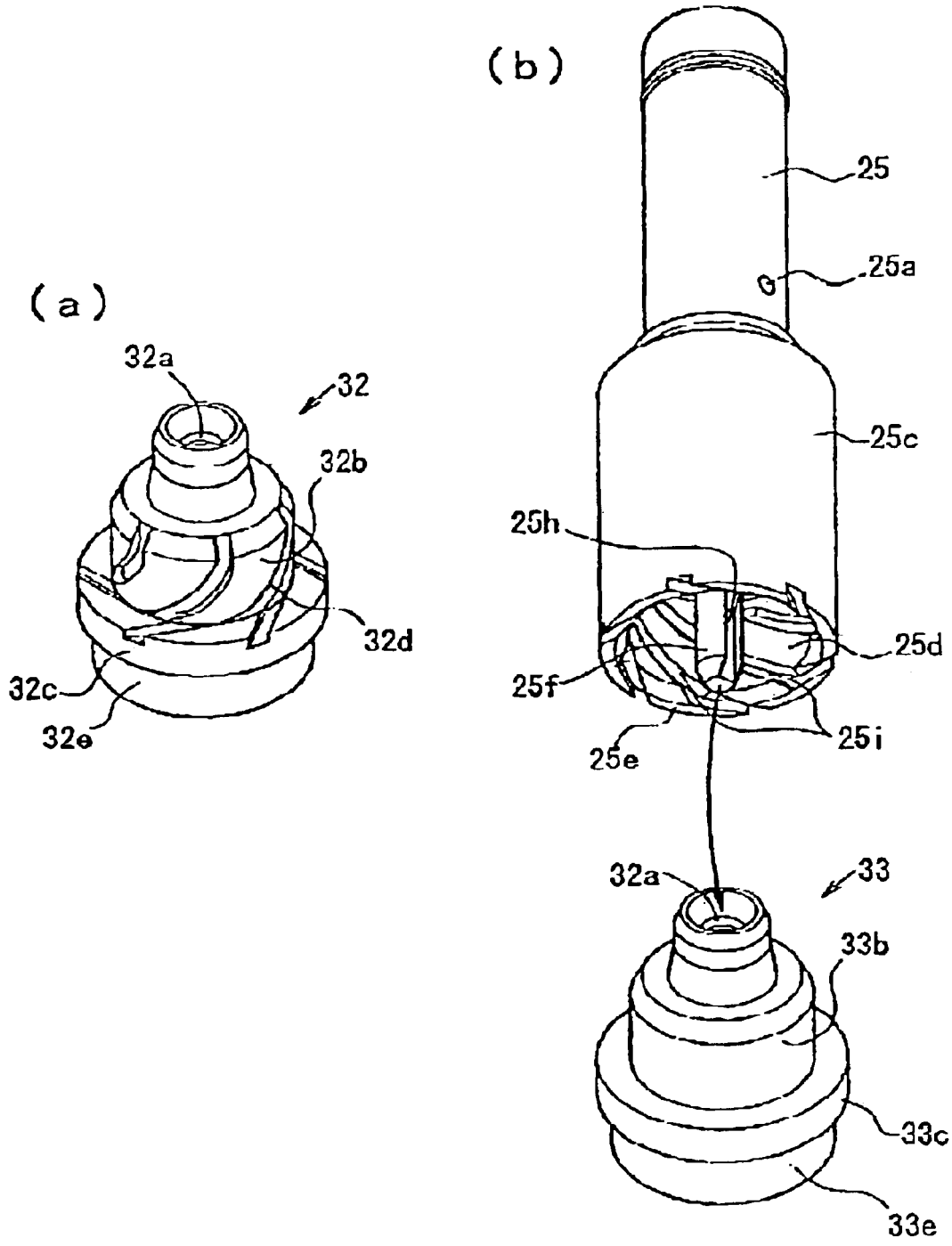
FIG. 5 illustrates a cylindrical attachment forming spiral grooves and a valve stem forming spiral grooves.

FIG. 5 illustrates another examples of the cylindrical attachment and the valve stem.

As shown in FIG. 5(*a*), the cylindrical attachment 32 forms the spiral-shaped grooves 32(*d*) for flowing contents on the outer surface 32(*h*) and the brim portion 32(*c*). This spiral-shaped grooves 32(*d*) correspond to the grooves 31(*d*) formed on the cylindrical attachment 31. The other structures are same as the cylindrical attachment 31.

As shown in FIG. 5(*b*), the valve stem 25 forms the spiral-shaped grooves 25(*l*) from the end 25(*e*) to the lower inner surface 25(*d*) of the cylindrical skirt 25(*c*). On the other hand, grooves are not formed on the cylindrical attachment.

In the dispensing apparatus employing the cylindrical attachment 32 or valve stem 25, in the mode in use the contents in the circular recess portion or in the upper stream thereof pass through the spiral-shaped grooves 32(*d*), 25(*i*).

The settled contents in the circular recess portion of the measured chamber receive mixing action caused by the spiral stream when the contents in the upper stream pass through the spiral-shaped grooves as well as the above-mentioned accelerated action and pressurized action. Therefore, the settled contents in the circular recess portion are curled up so as to sent to the aperture 25(*a*) certainly.

Here, instead of the cylindrical attachment 33, the cylindrical attachment with spiral-shaped grooves may be employed. In this case, the spiral grooves on the cylindrical attachment and the spiral grooves on the valve stem are formed so that they may not overlap each other.

Still more, spiral-shaped grooves may be formed on the outer surface of the annular skirt 25(*c*) of the valve stem 25 and/or the inner surface of the outer cylinder.

Figure 6:
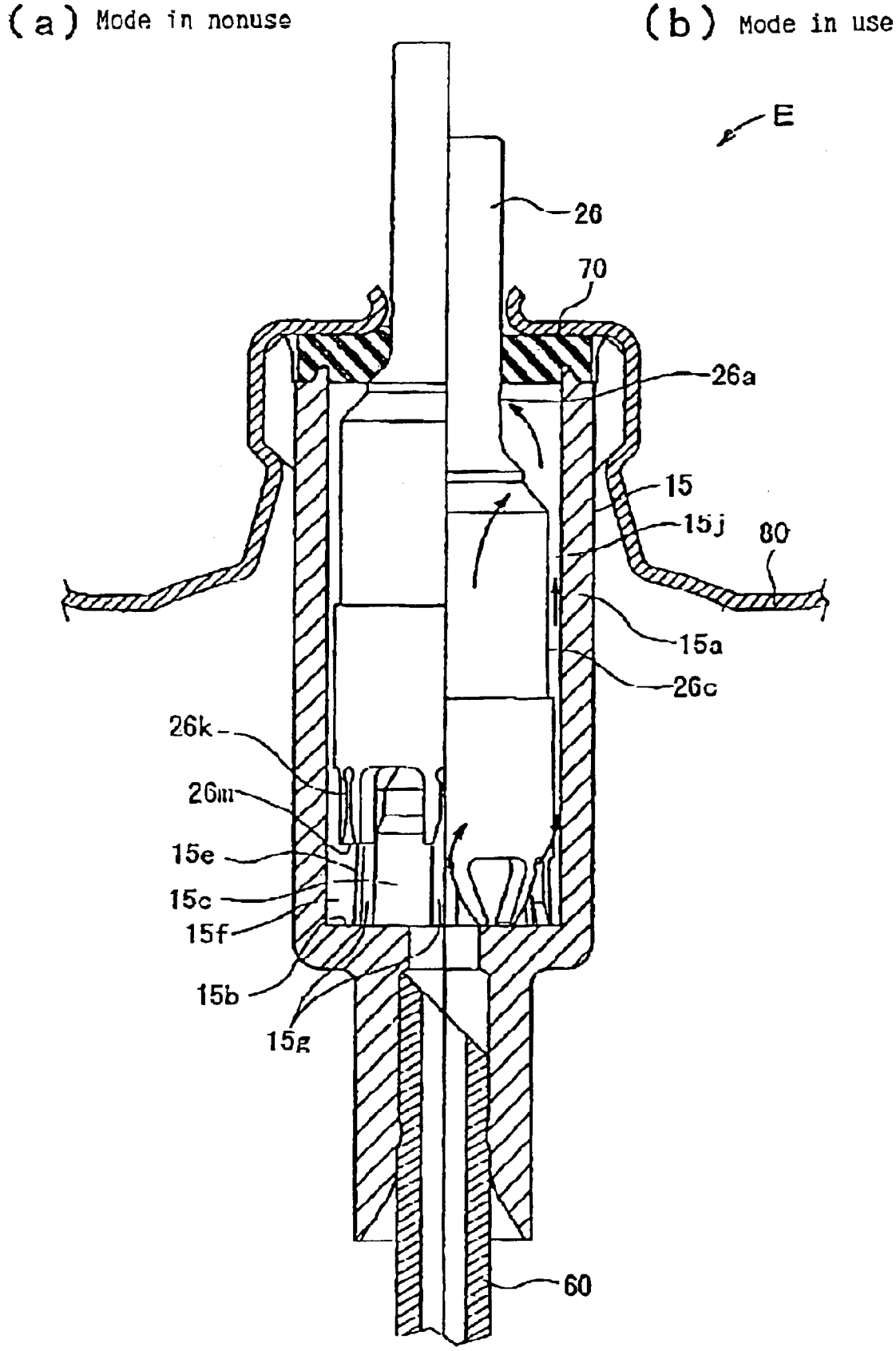
FIG. 6 illustrates a dispensing apparatus with a measured chamber (E), employing a fork-shaped valve stem.

FIG. 6 shows the dispensing apparatus (E) that the settled contents in the circular recess portion are so called scratched in order to sent them to the aperture effectively.

The dispensing apparatus (E) employs another type of the valve stem 26. The valve stem 26 forms thin fork-shaped portion 26(*k*) on the around of the lower end. Also, the grooves 15(*g*) are formed on the cylindrical standing portion 15(*c*) of the housing 15.

As shown in FIG. 6(*b*), in the mode in use, the end 26(*m*) of the fork-shaped portion 26(*k*) contacts the bottom 15(*b*) of the housing 15 and bends so as to scratch the settled powder in the circular recess portion 15(*f*).

Also, since the inner surface of the cylindrical skirt 26(*c*) contacts the convex portion 15(*e*) of the cylindrical standing portion 15(*c*) or the housing 15, the contents in the circular recess portion or in the upper stream of the powder keeping space flow through the narrow space between the fork-shaped portion 26(*k*) after passing the grooves 15(*g*) which have small cross sectional area.

As mentioned above, the settled contents in the circular recess portion 15(*f*) are scratched by the fork-shaped portion 26(*k*), also they are forced to be sent to the aperture 26(*a*) because the flow of the contents from the upper stream of the circular recess portion are accelerated and pressurized by the narrow space.

Figure 7:
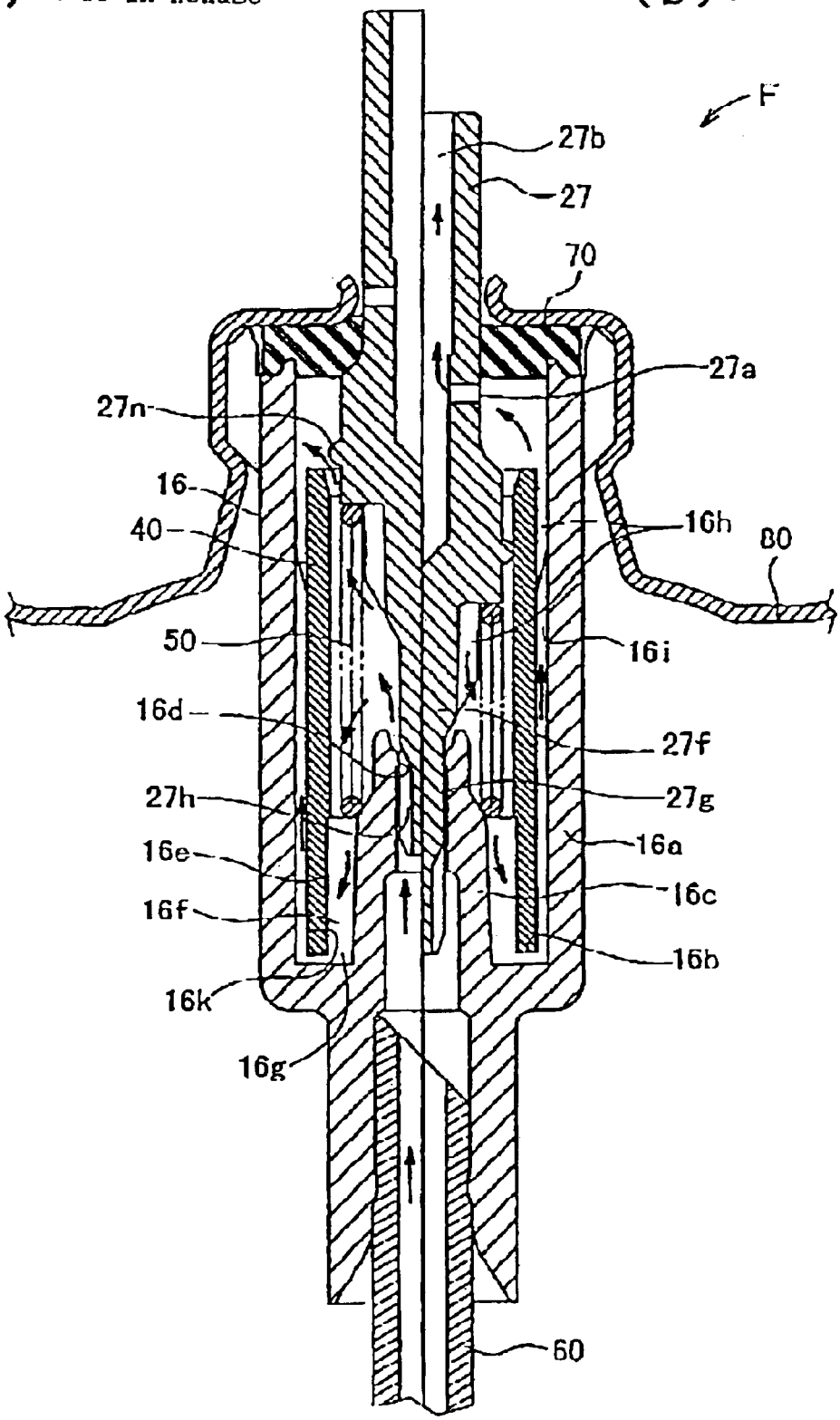
FIG. 7 illustrates a dispensing apparatus with a measured chamber (F), employing a cylindrical wall part instead of a cylindrical skirt of the dispensing apparatuses shown in FIG. 1 to FIG. 6.

As shown in FIG. 7, the dispensing apparatus (F) employs the cylindrical wall part 40 received on the convex portion 16(*b*), 16(*e*), 16(*k*) so as to allow the same function as the cylindrical skirt of the each valve stem shown in FIG. 1~FIG. 6, and the valve stem 27 forming the annular project portion 27(*n*) for contacting the cylindrical wall part 40 in a sealing manner. The circular recess portion 16(*f*) is comprised of the grooves 16(*g*), 16(*i*) for flowing the contents.

As shown in FIG. 7(*a*), in the mode in nonuse, the contents flow from the inside of the container to the inside of the housing 16 (the measured chamber 16(*h*)) through the dip tube 60, the grooves 27(*h*) of the valve stem 27, and a narrow space between the outer surface of the valve stem 27 and the upper end of the cylindrical wall part 40. The contents also flow the grooves 16(*g*), 16(*i*) of the circular recess portion 16(*f*).

As shown in FIG. 7(*b*), in the mode in use, the lower outer surface 27(*g*) of the valve stem 27 contacts the project portion 16(*d*) of the cylindrical standing portion 16(*c*) in a sealing manner. Also, the annular project portion 27(*n*) of the valve stem 27 contacts the upper inner surface of the cylindrical wall part 40 in a sealing manner.

According to these seal actions, the measured chamber 16(*h*) of the housing 16 is partitioned into the inside space and the outside space same as each dispensing apparatus shown in FIG. 1~FIG.6. The settled contents in the circular recess portion 16(*f*) are sent to the aperture 27(*a*) by the force of the upstream contents passing through the circular recess portion 16(*f*).

Instead of the annular project portion 27(*n*) of the valve stem 27, an annular project portion may be formed on the inner surface of the cylindrical wall part 40. In this case, a conventional valve stem can be employed.

In each dispensing apparatus without forming the spiral-shaped grooves 25(*i*), 32(*d*), the settled contents in the circular recess portion can be mixed by the flowing force when the upstream contents pass through the grooves of the circular recess portion.

The material stored in the aerosol type dispenser can include powdered metallic salts, powdered inorganic substances and powdered resins. For example, talc, kaolin, aluminum hydroxychloride (aluminum salt), barium sulfate, cellulose and mixture thereof. Also, ultraviolet absorbents, oil material, surface-active agent, moisturizing agents, high-molecular weight compound, antioxidant, sequestering agent etc. can be employed.

Discharging gas in the aerosol type dispenser can include LPG, dimethylether, fluorocarbon, carbonic acid, nitrogen gas, compressed air, oxygen, rare gas and mixture thereof.

What is claimed is:

1. A dispensing apparatus for dispensing a fluid from a container, comprising a cylindrical housing (11, 12, 13, 14, 15, 16), a cylindrical valve portion (11*c*, 12*c*, 13*c*, 15*c*, 16*c*, 31, 32, 33) in a radial distance from an outer part (11*a*, 12*a*, 13*a*, 14*a*, 15*a*, 16*a*) of the housing, a valve stem (21, 22, 23, 24, 25, 26, 27) movable in the housing for closing the cylindrical valve portion (11*c*,

12*c*, 13*c*, 15*c*, 16*c*, 31, 32, 33) so as to provide a measured chamber (11*h*, 12*h*, 14*h*, 16*h*), which valve stem extends out of the housing and is provided with an aperture (21*a*, 22*a*, 23*a*, 24*a*, 25*a*, 26*a*, 27*a*) for connecting between inside and outside of the measured chamber when the valve stem is moved down in a use mode of the dispensing apparatus, wherein a hollow cylindrical portion (21*c*, 22*c*, 23*c*, 24*c*, 25*c*, 26*c*, 40) surrounds the cylindrical valve portion in such a way that the fluid in the housing passes over an end (21*e*, 22*e*, 23*e*, 24*e*, 25*e*) of the hollow cylindrical portion adjacent to the cylindrical valve portion and through a space between the hollow cylindrical portion and the outer part of the housing to the aperture when the valve stem is moved down in the use mode to close the cylindrical valve portion by full contact.

2. Dispensing apparatus according to claim 1, wherein the hollow cylindrical portion (21*c*, 22*c*, 23*c*, 24*c*, 25*c*, 26*c*) is a part of the valve stem (21, 22, 23, 24, 25, 26).

3. Dispensing apparatus according to claim 1, wherein the valve stem (27) is movable within the hollow cylindrical portion (40).

4. Dispensing apparatus according to claim 1, wherein a flexible fork-shaped portion (26*k*) is formed on the end of the hollow cylindrical portion (26*c*), which end is adjacent to the cylindrical valve portion (15*c*).

5. Dispensing apparatus according to claim 1, wherein the cylindrical valve portion (31, 32, 33) is attached to the housing (14).

6. Dispensing apparatus according to claim 1, wherein convex portions (11*e*, 12*e*, 13*e*, 15*e*, 16*e*, 31*b*, 32*b*) are formed between grooves on an outer surface of the cylindrical valve portion (11*c*, 12*c*, 13*c*, 15*c*, 16*c*, 31, 32, 33) or on an inner surface of the hollow cylindrical portion (21*c*, 22*c*, 23*c*, 24*c*, 25*c*, 40) for providing a passage way between the outer surface of the valve portion and the inner surface of the hollow cylindrical portion.

7. Dispensing apparatus according to claim 1, wherein grooves (12*i*, 16*i*) are formed on the outer surface of the hollow cylindrical portion (22*c*, 40) or on the inner surface of the cylindrical housing (12, 16) for providing a passage way therebetween.

8. Dispensing apparatus according to claim 6, wherein the grooves are formed obliquely in relation to the longitudinal axis of the apparatus.

9. An aerosol-type dispenser comprising the dispensing apparatus according to claim 1, wherein discharging gas and contents are included in the container.

* * * * *